US006098895A

United States Patent [19]

Walzel et al.

[11] Patent Number: 6,098,895

[45] **Date of Patent: *Aug. 8, 2000**

[54] PROCESS AND A DEVICE FOR ATOMIZING LIQUIDS

[75] Inventors: Peter Walzel, Dormagen, Germany; Christian Reedtz Funder, Fredensborg, Denmark; Søren Birk Flyger, Søborg, Denmark; Poul Bach, Birkerød, Denmark

[73] Assignee: Niro A/S, Søborg, Denmark

[ * ] Notice: This patent issued on a continued prosecution application filed under 37 CFR 1.53(d), and is subject to the twenty year patent term provisions of 35 U.S.C. 154(a)(2).

[21] Appl. No.: 08/954,086

[22] Filed: Oct. 20, 1997

Related U.S. Application Data

[63] Continuation of application No. 08/525,564, filed as application No. PCT/DK94/00113, Mar. 21, 1994, abandoned.

[30] Foreign Application Priority Data

Mar. 19, 1993 [DE] Germany ..... 43 08 842

[51] Int. Cl.[7] ..... B05B 17/04

[52] U.S. Cl. ..... 239/7; 239/223; 239/224; 239/225

[58] Field of Search ..... 239/223–225, 239/7

[56] References Cited

U.S. PATENT DOCUMENTS 2,920,834 1/1960 Nyrop et al. ..... 239/224 X
3,197,143 7/1965 Norris ..... 239/223
3,250,473 5/1966 Hege .
4,898,331 2/1990 Hansen et al. ..... 239/223

FOREIGN PATENT DOCUMENTS 2 662 374 11/1991 France .

*Primary Examiner*—Kevin Weldon
*Attorney, Agent, or Firm*—Sughrue, Mion, Zinn, Macpeak & Seas, PLLC

[57] ABSTRACT

The liquid to be atomized is uniformly sprayed on the inner surface of a hollow rotating cylinder, for example by means of one- or two-fluid-nozzles and is thus distributed on bores provided in the cylinder wall. The rotation of the cylinder causes the liquid to flow outwards through the bores. Droplets are generated when the liquid flows out of the bores by laminary decomposition of the jet. The flow rate in each bore lies in the range $\mathbf{1.0}<\dot{V}_B\ (a^3\ \rho^5/\sigma^5)^{0.25}<\mathbf{16}$ to prevent the droplets from becoming too large and to satisfy the condition of an adequate flow laminarity, i.e. for the value of the Reynolds number for the continuous liquid flow in the boress not to exceed $Re_\delta$ 400. $\dot{V}_B$ represents the flow rate of the liquid in each bore, a represents the centrifugal acceleration at the outer surface of the cylinder, ρ represents the density of the liquid and δ indicates the surface tension of the liquid. The large number N>200 of bores having the diameter $D_B$ in the cylinder wall causes the flow rate of liquid through each bore to be relatively low, so that a continuous laminary flow in each bore is ensured even at low viscosities and technically useful total flow rates. Preferably cylindrical bores with a minimum length at least three times larger than the bore diameter are provided in the cylinder wall, with a narrow spacing in the range defined by $\mathbf{1.1}<t/D_B<\mathbf{5}$, so that a number of bores as large as possible may be arranged in the wall of the cylinder.

29 Claims, 8 Drawing Sheets

Section A - A

PROCESS AND A DEVICE FOR ATOMIZING LIQUIDS

This is a continuation of application Ser. No. 08/525,564 filed Nov. 14, 1995 now abandoned, Ser. No. 08/525,564 is the national stage of Pat/DK94/00113.

BACKGROUND OF THE INVENTION

1. Field of the Invention

The present invention relates to a process for producing droplets with a narrow size distribution from liquids. The term liquid used in connection with the invention covers both clear liquids, such as solutions, and for instance metal melts and flowable dispersions, like for instance suspensions.

2. Description of the Prior Art

Producing droplets from liquids is often termed atomization. Common atomizing processes used commercially at a large scale are spraying under pressure in single-fluid pressure nozzles, for instance hollow cone nozzles, spraying with a gas in two-fluid-nozzles or pneumatic atomization, and the atomization with rotary atomizers. The invention also relates to processes according to the last-mentioned principle.

In many technical processes a narrow droplet size distribution is desired. This is, inter alia, because spray drying plants must be dimensioned according to the biggest droplets of the spray, as these droplets require the longest residence time in the drier. Thus a broad droplet spectre means in spite of a lower average droplet size large and consequently unfavourable dimensions. The smallest droplets in the spray necessitate high costs for cleaning the discharge air in form of filters and cyclones or the like devices. A broad droplet size spectrum moreover leads to a broad particle size distribution of the produced spray-dried powder and consequently in some cases to undesirable technical properties.

Up until now all known atomization processes which are used technically at a large scale, i.e. a production capacity of more than 100 kg/h, produce droplets with comparatively broad size spectres. See for instance Chem.—Ing. Techn. 62 (1990) 12, pp. 983–994.

Admittedly, droplets with a fairly narrow size distribution may be obtained with rotary atomizers of commonly used design. Thereby, the effect of the laminar jet disintegration is utilized. If the liquid is delivered to the centre of a plane round rotating disc, it flows, when a certain limited liquid production is kept, as a laminar film radially outwards and forms at the trailing edges of the disc threads of liquid. The liquid threads are created at the periphery of the trailing edge in a natural way with regular spacing. The subsequent disintegration of the liquid threads results in droplets with a very narrow size spectre. If the size distribution of the droplets talus attained is described, for instance with the RRSB function according to DIN 66 141, then an evenness parameter of $6<m<8$ is attained. As average droplet size $d_{v.50}$ is in the present text the droplet diameter defined, at which the 50%-value of the volume distribution is obtained; i.e. that 50% of the sprayed liquid volume get smaller droplet diameters—and 50% of the sprayed liquid get a bigger droplet diameter than $d_{v.50}$.

A considerable drawback of the atomizing method with plane rotating discs is that the amount of liquid passing this flow area is very small. As an estimate, the passing amount $\dot{V}$ of low-viscous liquids will lie in the range of $0.21<\dot{V}(\rho^3 n^2/D^3\sigma^3)^{0.25}<0.32$. D is the disc diameter, ρ the liquid density, σ the surface tension of the liquid, and n the speed of rotation. Both the narrow limits of the throughput range and the low value of the throughput of liquid hinder widespread use of this process.

In order to obtain a higher throughput it has been suggested to arrange several discs over each other, Chem.—Ing.—Techn. 36 (1964) 1, pages. 52–59. A uniform distribution of the liquid on the discs is however difficult to obtain with a device that does not easily clog. The narrow throughput range is also in this connection a drawback.

Recently, discs or cups have been used, which at their periphery are provided with evenly spaced notches or grooves, for spraying of lacquers. In this way the throughput range can be broadenend while maintaining in this connection a drawback.

Recently, discs or cups have been used, which at their periphery are provided with evenly spaced notches or grooves, for spraying of lacquers. In this way the throughput range can be broadenend while maintaining laminar jet formation. However, also with this embodiment the throughput range is insufficient for many technical purposes.

FR A-2 662 374 discloses an atomizer rotor which is capable of working with varying volume, a homogenous atomization being obtained even of high-viscous liquids. This atomizer rotor is on the outside provided with grooves, to which the liquid to be atomized is supplied through perforations in the cylindrical wall of the rotor. It is stated that the length of these perforations must never exceed their double diameter. The liquid to be atomized is distributed on the inner side of the rotor by a stationary tube. It seems in particular to be grooves arranged on the exterior of the rotor that are to ensure an even droplet size at the atomization, and the advantage obtained is limited.

The atomizer normally used for spray drying consists of a, low, cylindrical body, most frequently called atomizer wheel, said body having bores or ducts. The diameter of the bores are normally in the range of 5–30 mm. The liquid is often supplied centrally and flows radially outwards and leaves the atomizer through the bores. The design has admittedly the advantage that the comparatively big bores normally do not clog, but the throughput for large scale technical uses is chosen so high that the liquid leaves the bores in thick turbulent jets. Due to the high relative speed between the liquid and the surrounding gas the liquid jets which already leave the openings turbulently are dispersed. Thereby droplets are created at high rotational speed which is necessary in respect of small droplet dimensions, said droplets having a very broad size spectre. At the same time a considerable wear of the walls of the bores occurs when suspensions are atomized on account of the high flow speed.

SUMMARY OF INVENTION

The turbulence in the liquid jets is on account of the high relative speed between liquid and the gas surrounding the atomizer still further enhanced. It is known that a high jet turbulence always leads to droplets with a broad size spectrum. Usual evenness parameters of the RRSB distribution lie approximately in the range $2<m<4$. Typical liquid throughputs lie with the conventional process, for instance bores in the wall of a rotating hollow cylindrical body (cylinder) to a comparatively small and equal value. At the same time on account of the throughput limit per bore a plurality of bores is necessitated, in order to obtain technically desired throughputs. The liquid flows laminarily at suitable low throughputs through the bores, so that when leaving the bore a laminar jet disintegration takes place. Provides that the throughput per bore remains the same and sufficient bore lengths are provided for, the diameter of the bores may surprisingly be changed within broad limits without any perceptible effect on the droplet size. In this way, fine droplets with narrow size distribution may be obtained at comparatively low speed and with comparatively big bores, with very little tendency to clog. Thereby the droplet size is determined to a high degree by the throughput and the number of bores, to a small degree by the rotary speed of the atomizer, and to a very little degree by the liquid density and the surface tension. The small flow rate in the bores further provides the advantage that no substantial wear occurs.

The minimum throughput per bore is determined by the lower limit, which is necessary for the formation of a jet. For low-viscous liquids the throughput per bore amounts according to measurements to:

$$\dot{V}_B=1.0\ (\sigma^5/a^3\ \rho^5)^{0.25}.$$

The maximum advisable throughput is determined on basis of the recognition that with increasing throughput of liquid in the present process the droplet size increases by approx. $(V_B)^{0.33}$ and that the turbulence in the leaving liquid threads at a low viscosity results in a broadening of the droplet spectre. As a practical value for the throughput the following value can be given $$\dot{V}_B=16\ (\sigma^5/a^3\ \rho^5)^{0.25}$$

Furthermore, according to the present process the Reynolds number in the bores should not exceed the value $Re_\delta=400$, to ensure that the flow in the bores remains laminar. This is a prerequisite for the desired narrow droplet spectrum. If the Reynolds number $Re_\delta=200$ is not exceeded, it is ensured that the flow remains laminar. The Reynolds number can be calculated from the liquid throughput according to $$Re_\delta=a\ \delta^3_{hy}\rho^2/3\ \eta^2$$

$\eta$ is in this connection the dynamic viscosity of the liquid. The hydraulic depth of the stream, which describes the flow condition in the bores having the diameter $D_B$, results with good approximation, for the range characteristic for the process, from:

$$\delta_{hy}=1{,}06[\dot{V}_B\ \eta/(a\ \rho(D_B)^{0.5}]^{2/7}.$$

From these equations the conditions for a sufficient laminarity of the flow are obtained with a Reynolds number $Re_\delta=400$, viz.

$\dot{V}B<3195\ (\eta^2/a\ \rho^2)^{7/6}(a\ \rho(D_B)^{0.5}/\eta)$. The evenness parameter of the RRSB distribution lies under this condition in the range of $6<m<8$ which is characteristic for the laminar jet disintegration.

The invention relates to a process for atomizing liquids by means of a hollow, rotating cylinder provided with bores in the cylinder wall, comprising the improvement that the liquid is evenly distributed in the interior of the cylinder on the inner cylinder surface and over the bores and in that the flow rate of the liquid per bore lies within the range $1.0<\dot{V}_B(a^3\ \rho^5/\sigma^5)^{0.25}<16$ and that $\dot{V}_B<3195\ (\eta^2/a\ \rho^2)^{7/6}(a\ \rho(D_B)^{0.5}/\eta)$, $\dot{V}_B$ represents the flow rate of the liquid per bore, a: is the centrifugal acceleration at the outer surface of the cylinder, $\rho$: is the density of the liquid, $\sigma$: is the surface tension of the liquid and $\eta$: is the dynamic viscosity of the liquid, the centrifugal acceleration a being determined by the relation $a=2\ D\ \pi^2n^2$, where $\sqrt{D}$ is. D the diameter of the outer cylinder surface and n the number of revolutions of the cylinder. The total volume flow $\dot{V}$ results from the volume flow $\dot{V}_B$ per bore multiplied by the number N of bores in the cylinder.

If it is desired to operate using a Reynold figure of the stream in the bores, which does not exceed the value 200, the condition $\dot{V}_B<1410\ (\eta^2/a\ \rho^2)^{7/6}\ (a\ \rho\ \sqrt{D_B}/\eta)$ must be met.

In spray drying it may occur that product deposits form at the outlet of the bores in the rotary atomizer. Such deposits can be avoided by introducing gas, preferably drying gas which is saturated with solvent vapour, or by introducing solvent vapour or water vapour in the cylinder. When atomizing melts the introduction of heated gas into the cylinder causes a pre-heating of the body and during operation the temperature is thereby maintained in order to avoid the formation of deposits. As will be demonstrated later, a deflection of the droplets in the axial direction can also be obtained by means of the gas in connection with a suitable orientation of the bore axes.

The invention also relates to a process, which is characteristic in that in addition to liquid gas is also introduced into the cylinder.

Introduction of liquid into the cylinder may for instance take place via a small tube, which is placed above a baffle plate rotating together with the cylinder. The baffle plate is preferably placed in the middle of the cylinder and fixed to the bottom thereof. The liquid which leaves the small tube in form of a jet, is slung outwards by the baffle plate and consequently onto the interior cylinder surface and thereby distributed over the apertures.

The homogenous distribution of the liquid on the interior cylinder surface may take place in a particularly simple way by spraying with one-fluid-nozzles or with pneumatic spraying nozzles, also often called two-fluid-nozzles. One-fluid-nozzles, which produce a conical jet, have turned out to be particularly advantageous. Another advantageous way of distributing the liquid in the interior of the cylinder is to spray it onto the interior of the cylinder by concentrically arranged rotary nozzles, in particular nozzles providing a flat spray.

The invention relates to a process which is characteristic in that the liquid is injected into the cylinder by means of a one-fluid nozzle or a pneumatic atomizing nozzle and is in this way evenly distributed on the inner cylinder surface and on the bores, as well as a process, which is characteristic in that the liquid is injected into the cylinder through one or more rotating nozzles. Moreover, the invention relates to a process according to which the nozzle produces a hollow conical spray jet.

A preferred device for carrying out the process according to the invention consists of a hollow cylinder, in the wall of which a plurality of apertures are provided. To enable throughputs sufficient for commercial use the number of apertures is at least 200. In the most simple embodiment the apertures are cylindrical bores. The cylinder is closed at the bottom by a bottom and has at the top a cover with a central aperture. Through this an axial discharge of the liquid is avoided.

The diameter of the bores in the cylinder wall should be chosen in such a way that on one hand a number as large as possible can be arranged in the cylinder surface, and on the other hand so that clogging of the bores is avoided by sufficient dimensions. The spacing of the bores should be as narrow as possible in order to allow the largest possible number of bores in the cylinder jacket. Through a sufficient bore length is ensured that all droplets from the spraying nozzles end in the bores and unite in one liquid stream.

Typical ratios of the spacing t of the bores on the exterior cylinder jacket to the diameter $D_B$ of the bores lie in the range $1.1<t/D_B<5$. The minimum spacing results from the strength of the body sufficient at the required number of revolutions. The minimum diameter of the bores should not be smaller than $$D_B=10\ (\sigma/\rho\ a)^{0.5}$$

in order to reduce the risk of clogging sufficiently. In this connection $a=2\ \pi^2\ D\ n^2$ means the centrifugal acceleration on the exterior surface of the cylinder with the diameter D, σ/ is the surface tension of the liquid, ρ/ is the density of the liquid. By this choice of diameter the bore is not filled with liquid over the whole cross-section, a liquid stream is created by the effect of the Coriolis acceleration equal to the flow in a partially filled sewer with little inclination. Though in principle there is no maximum value for the bore diameter, it is reasonable to choose for average droplet sizes $d_{v.50}<100\ \mu m$ a maximum diameter of not more than $D_B=50\ (\sigma/\rho\ a)^{0.5}$, and for average droplet size $d_{v.50}<100\ \mu m$, a bore diameter $D_B<200\ (\sigma/\rho\ a)^{0.5}$, in order to allow a sufficient number of bores to be arranged in the cylinder. By choosing the ratio of the bore length $L_B$ to the bore diameter $D_B$ to be at least 3, variations occurring in the delivery of liquid are equalized before the bore outlet is reached. Besides round, that means cylindrical, bores, bores or apertures with other cross-sections than circular ones, for instance rectangular or triangular bores or larger apertures with various V-shaped flow grooves, can be used. Quadrangular bores have the advantage that lower Reynolds numbers are attained in the bores with the same throughput and the same dimensions of the apertures. They are, however, more difficult to produce and lead to a reduced cylinder strength. As in case of cylindrical bores, it is also possible in connection with rectangular and triangular apertures and for apertures having several V-shaped grooves to determine an expression for the hydraulic depth of the flow and thereby to obtain a condition for a sufficient laminarity. As is the case with cylindrical bores, conditions may also be set up in order to avoid clogging and to obtain a sufficient number of channels.

When atomizing suspensions it is preferable to use an apparatus, in which the bores are counterbored in the interior of the cylinder in such a way that no cylindrical surface remains in the interior. Through these measures dispersed particles from the suspension are prevented from being deposited and caking on the cylinder surface.

Also in connection with larger apertures with several V-shaped channels it is possible by means of the width of the aperture to reduce the interior cylinder surface. With larger apertures with several V-shaped channels the safety against clogging is increased. The same flow is obtained in a V-shaped channel as in the corner of a triangular aperture.

A particularly even distribution of the liquid flow at a low throughput per bore, which is typical for the process, takes place in a device, in which the bore edges at each bore are projecting inwardly to the same extent. Thereby a cylindrical liquid layer is created in the rotating cylinder. By supply of more liquid, the liquid flows regularly over the projecting bore edges into the bores.

In a simple way such a device can be produced by small tubes being inserted in the somewhat larger bores in the cylinder wall, said tubes all projecting with the same distance over the interior cylinder wall. Another possibility of producing a device with inwardly projecting bore edges consists in arranging grooves in the direction of the cylinder-generatrix as well as grooves in the peripheral direction between the bores in the interior of the cylinder. This process is preferably suitable for bores which are arranged with rectangular spacing.

The invention also relates to a device for atomizing liquids having a rotating hollow cylinder, which at the bottom side is closed by a bottom and at the upper side is limited by a cover with a central opening, characterized by bores with a diameter $D_B$ in the cylinder wall, a bore spacing t on the outer cylinder surface in the range of $1.1\ D_B<t<5\ D_B$, a ratio of the length $L_B$ of the bores to the diameter $D_B$ of the bores of at least 3, as well as bore diameters in the range $10<D_B\ (\rho\ a/\delta)^{0.5}<50$, for the production of droplets with an average size which is bigger or the same as 100 μm, and bore diameters in the range $10<D_B\ (\rho\ a/\sigma)^{0.5}<200$ for the production of droplets with an average droplet size smaller than 100 μm.

Moreover, the invention relates to a device for atomizing liquids with a hollow cylinder having at least 200 bores in the cylinder wall, a device with cylindrical bores and a device, in which the bores in the cylinder wall in the interior of the cylinder are provided with such recesses that no interior cylinder wall remains. Another object of the invention is to provide a device for atomizing liquids with hollow rotating cylinders, said device being characterized in that the bore edges in the interior of the cylinder are projecting with the same distance over the interior cylinder surface.

In particular in respect of low-viscous liquids, or when the Reynold number $Re_\delta$ in bores extending radially resumes a larger value than 400, is it an advantage if the bores in the cylinder in the rotary plane are inclining in relation to the radial direction. In low-viscous liquids the turbulence of the liquid threads leaving the bore can be reduced thereby that the outwardly extending bore axes at their point of intersection with the exterior cylinder surface keep an angle $\alpha<90°$ in relation to the vector of the peripheral speed (forwards inclination), whereby the the rotation causes an accumulation of liquid to take place in the bore. By this measure, the effective acceleration in the axial direction of the bores is reduced. For instance at an angle inclination of $\alpha=27{,}5°$ the effective acceleration is halved in the axial direction of the bores in comparison with $\alpha=90°$. Thereby the flow speed in the bores is reduced and the depth $\delta_{hy}$ of the stream increased. By high-viscous liquids and in particular by suspensions the angle $\alpha>90°$ should be chosen (backwards inclination) to avoid sedimentation of solid particles. The higher viscosity provides also at $\alpha>90°$ a sufficient laminarity of the flow. The bores may be straight but also curved.

If the bores are made in such a way that the bore axes have an inclination β towards the plane of rotation, which is defined by those circles, which are described by the rotating intersection points of the bore axes through the exterior cylinder surface, the droplets moreover get an impulse in the axial direction of the cylinder. Particularly effective is the deflection in the axial direction of the cylinder caused by the gas supplied to the cylinder. The radial extension of the spray is reduced thereby and the use of the process in slim spray towers is made possible. Also in this device is the effect seen that at the same throughput a smaller Re—figure occurs than in case of radially extending bores.

If the described directions of inclination of the bore axes are combined, a skew arrangement of the bore axes relative to the cylinder axis is obtained. Also this embodiment is for instance advantageous in the spray drying of low-viscous liquids in slim towers.

The invention relates to a device, which is characterized by bores having such dimensions that the extension of their axes over the exterior cylinder surface all keep the same angle $\alpha$ in the range of $10° < \alpha < 170°$ in relation to the vector of the peripheral speed, and to a device, which is characterized in that the extension of the bore axes over the exterior cylinder surface are inclined by the angle $\beta$ in the range of $O < \beta < 80°$ in relation to the plane of rotation.

Irregularities in distribution of the liquid on the interior cylinder wall and on the bores can be avoided by a rotationally symmetrical distribution body, which is concentrically mounted in the cylinder and the diameter of which increases towards the bottom of the cylinder. A particularly simple embodiment is a distribution body which is fastened in the cylinder. If the distribution body is independently rotatable from the cylinder, a favourable number of revolutions of the distribution body for distribution of liquid can be set at any chosen number of revolutions of the cylinder.

A particularly advantageous embodiment of a distribution body comprises a body, which is provided with grooves on its upper surface, said grooves extending in the peripheral direction, whereby various circular discharge edges are created. Thereby portions of liquid are ejected at various levels in the direction of the interior cylinder surface. This causes an even distribution of liquid. An advantageous embodiment of a distribution body consists of circular plates, which are connected by spacers. In this embodiment the diameter and distance of the circular plates can be changed in a simple way in dependence on the requirements to the distribution of the liquid supplied to the cylinder.

An object of the invention is to provide a device for atomizing liquids with a hollow rotating cylinder, which comprises a rotationally symmetrical distribution body arranged concentrically in the cylinder distribution body, the diameter of which increases towards the bottom, and a device which is characterized by a distribution body which is fixed to the cylinder.

Moreover, the invention relates to a device for atomizing liquids with a hollow rotating cylinder, which device is characterized by a distribution body which is rotatable independently of the cylinder.

Further the invention relates to a device for atomizing liquids with a hollow rotating cylinder, which device is characterized in that the distribution body is provided with grooves running in the peripheral direction, and a device, in which the distribution body consists of circular plates and spacers.

Likewise the invention relates to a device for atomizing liquids with hollow cylinders, said device being characterized by bores in the cylinder wall, the edges of which protrude into the interior of the cylinder and protrude with the same distance over the interior cylinder surface.

The same throughput per bore in the cylinder can, in particular with respect of liquids, which do not contain any solids, also be obtained by means of a cylindrical porous layer with uniform wall thickness. For instance filter layers or porous sinter bodies come into consideration.

Irregularities of the spray of the nozzles can, moreover, besides be equalized by baffles which are built into the cylinder. The baffles may rotate with the cylinder or also rotate with a different direction of rotation or a different number of revolutions from that of the cylinder. The baffles give a radial and axial distribution of liquid in the cylinder. Preferred embodiments of these baffles consist of concentrically perforated cylinders which rotate with the cylinder and which are fixed to the cylinder, of helically wound perforated plates or of wire netting. The mesh width, i.e. the size of the apertures in the baffles, is to be larger than the diameter of the bores in the cylinder.

The invention also relates to a device for atomizing liquids with rotating hollow cylinders, which comprises a second cylindrical porous body which is concentrically mounted in the cylinder and the wall thickness of which is uniform, and a device, which is characterized by baffles built into the cylinder.

An object of the invention is also to provide a device for atomizing liquids with rotating hollow cylinders, which device is characterised by baffles in the cylinder which are rotatable independently of the cylinder, and characterized by baffles in form of concentrically arranged, cylindrical, perforated plates, and in form of concentrically arranged wire netting, and by baffles, in which the hole diameter, i.e. the mesh width, is larger than the diameter of the bores in the cylinder wall.

The invention also relates to a device for atomizing liquids with rotating hollow cylinders, said device having built in baffles in form of perforated plates and/or wire nettings, which are helically wound.

The device according to the invention for atomizing liquids and having rotating hollow cylinders is particularly suited for the manufacture of spray dried powder with an average droplet size of 50 $\mu$m to 400 ρm from liquids, for the manufacture of powders from organic melts with grain or droplet size in the range of 0,5 mm–3 mm, and in particular for metal powder from melts with grain or droplet size in the range of 10 to 100 ρm. The droplet sizes mentioned here are, however, solely typical values for the above-mentioned uses. It is, of course, possible with the device according to the invention to cover also a wider range of droplet sizes. A further area of use for the device according to the invention is in scrubbing plants for gas for removal of dust and washing out chemical substances.

An object of the invention is the use of a device for atomizing liquids, said device having rotating hollow cylinders, for spray drying, for the manufacture of powders from melts, and the use of the device for gas purification.

As material for the cylinder metal, plastics and ceramics are preferably used.

The invention will be described in detail with reference to the accompanying drawings.

BRIEF DESCRIPTION OF THE DRAWING

Description of the Preferred Embodiments

Figure 1:
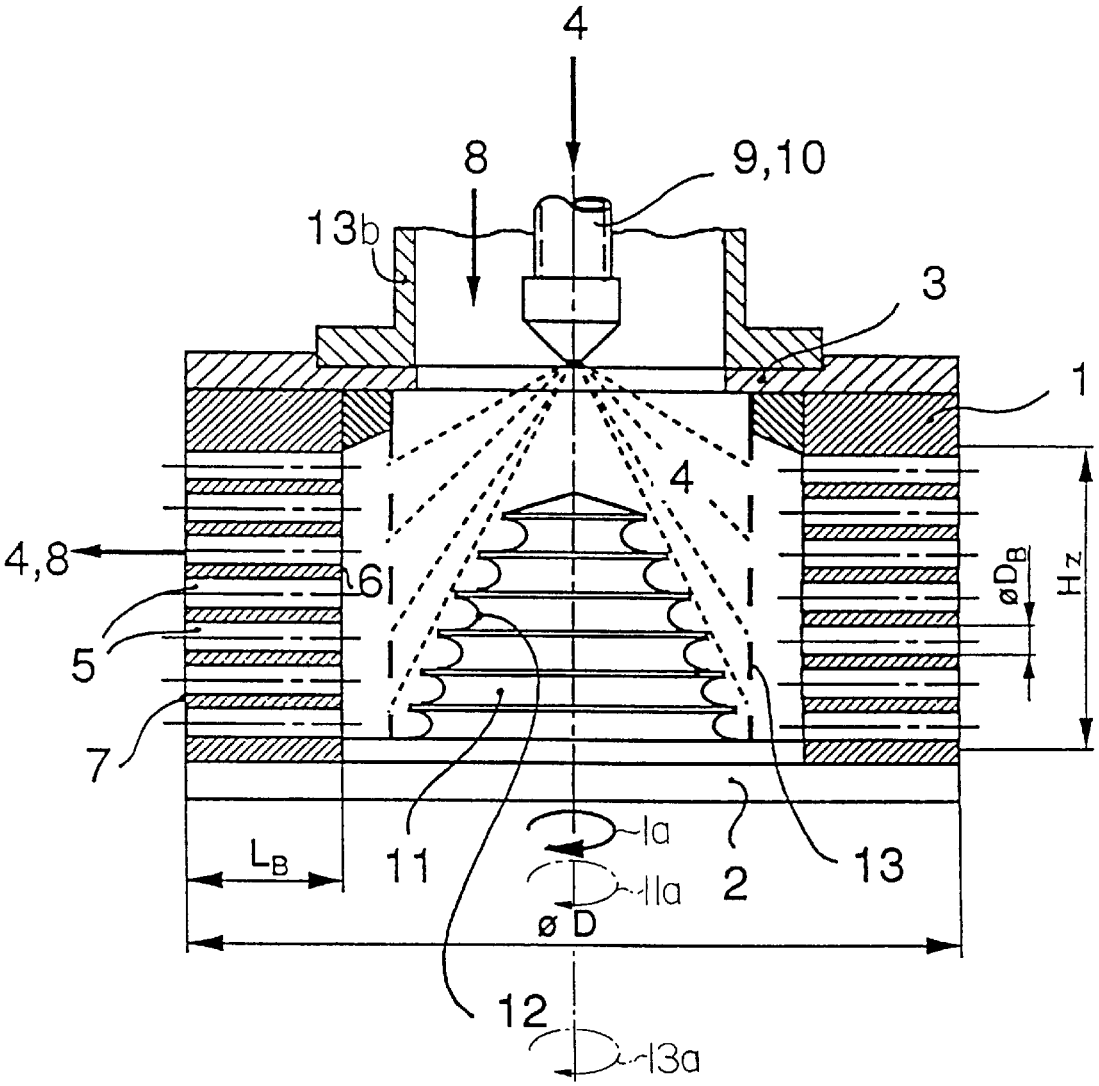
Figure 2A:
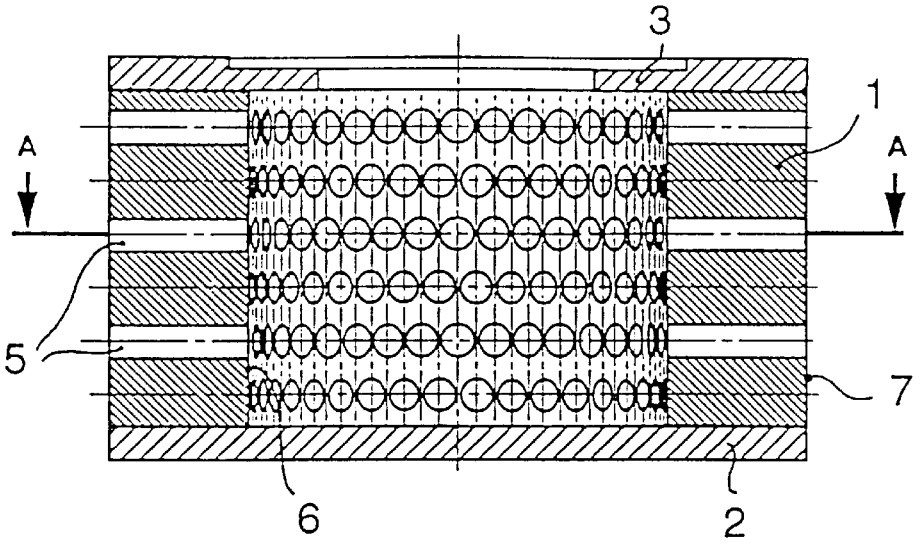
Figure 2B:
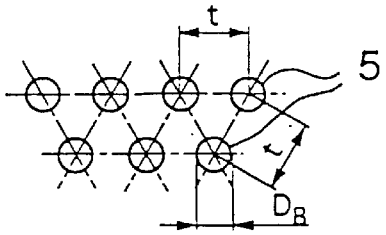

FIG. 1 is a side cut away view of a first embodiment of this invention;

FIG. 2*a* is an axial sectional view of the embodiment of FIG. 1;

FIG. 2*b* illustrates a segment of the exterior cylindrical surface of FIG. 2*a;*

Figure 2C:
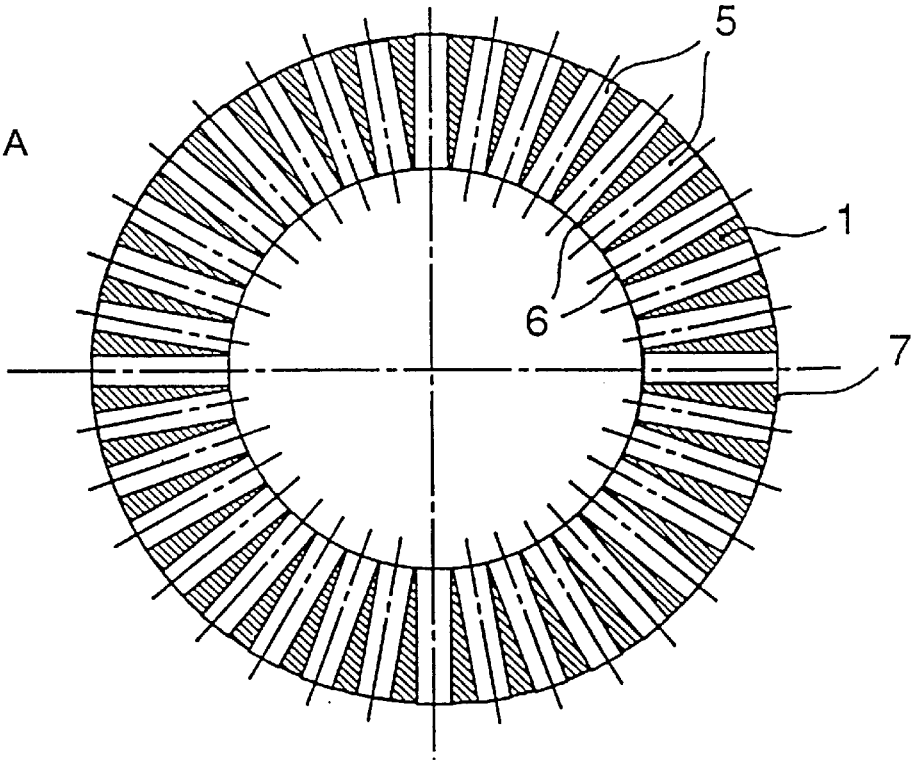

FIG. 2*c* is a cross-sectional view of the perforated cylinder in the rotational plane along section line A—A in FIG. 2*a;*

Figure 3:
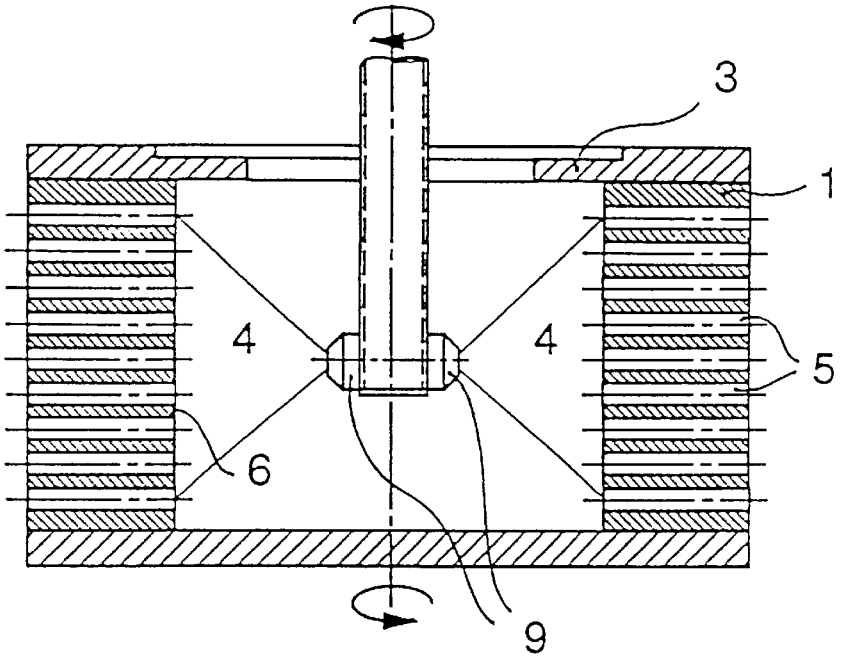
Figure 4:
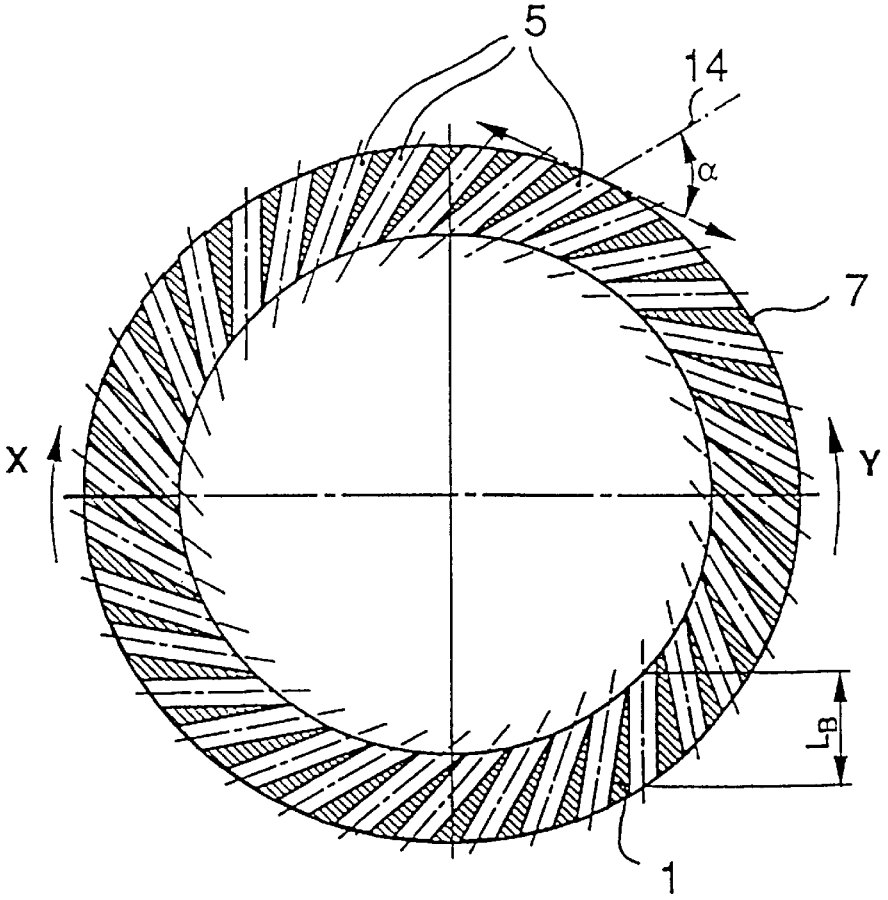
Figure 5:
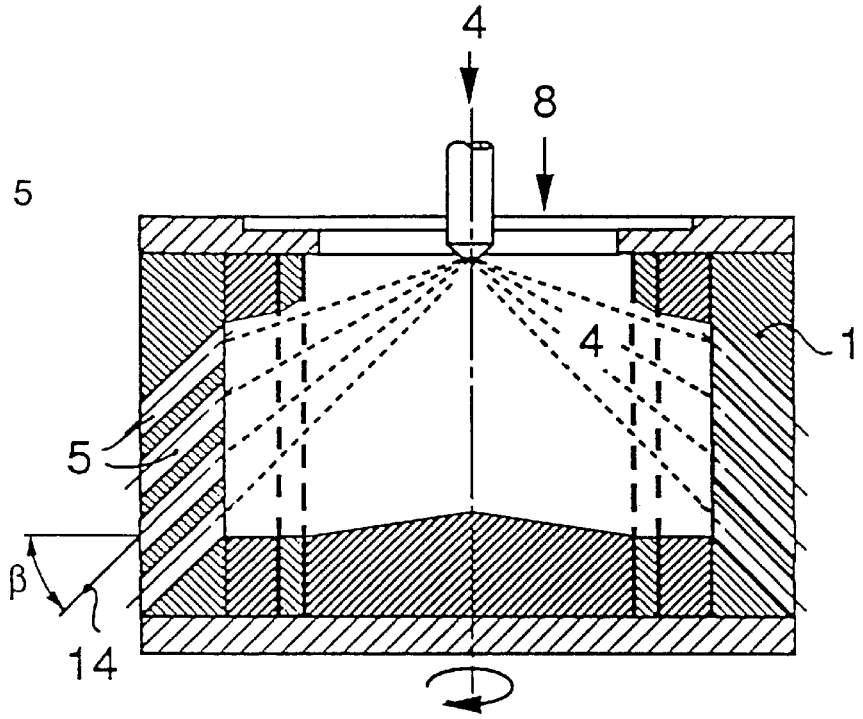
Figure 6:
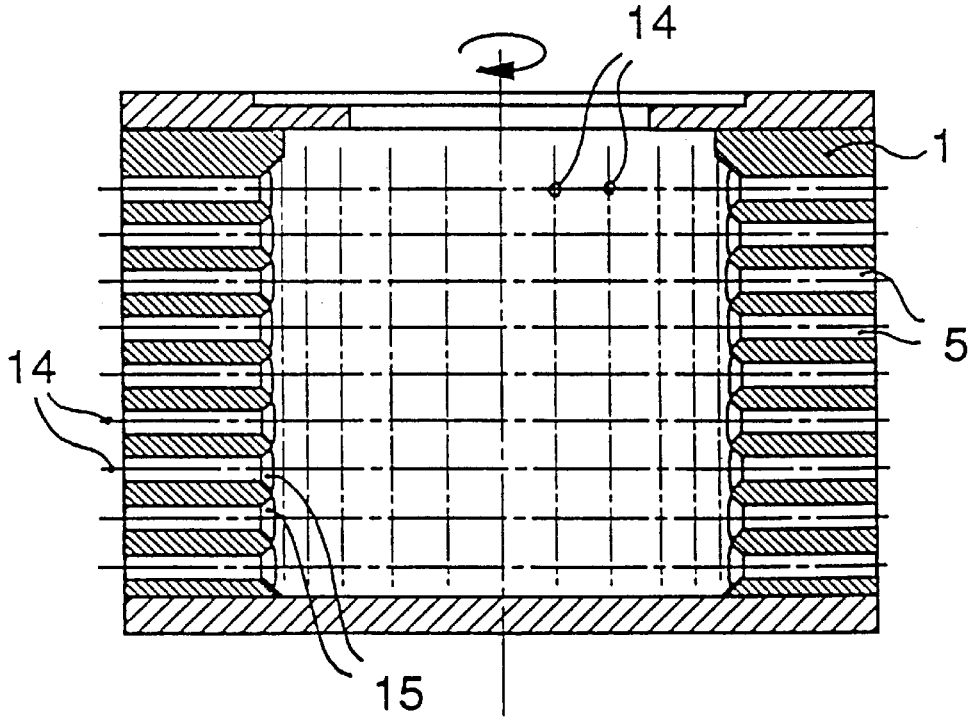
Figure 7:
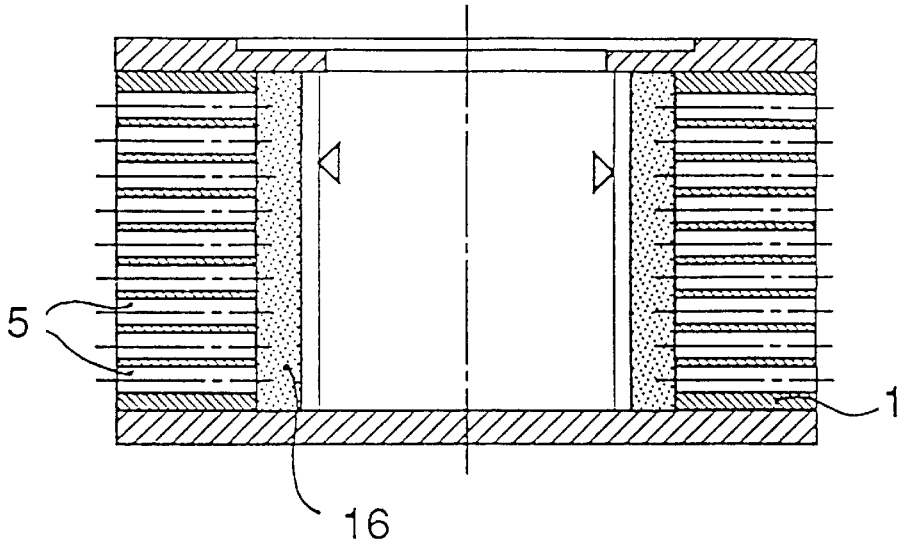
Figure 8:
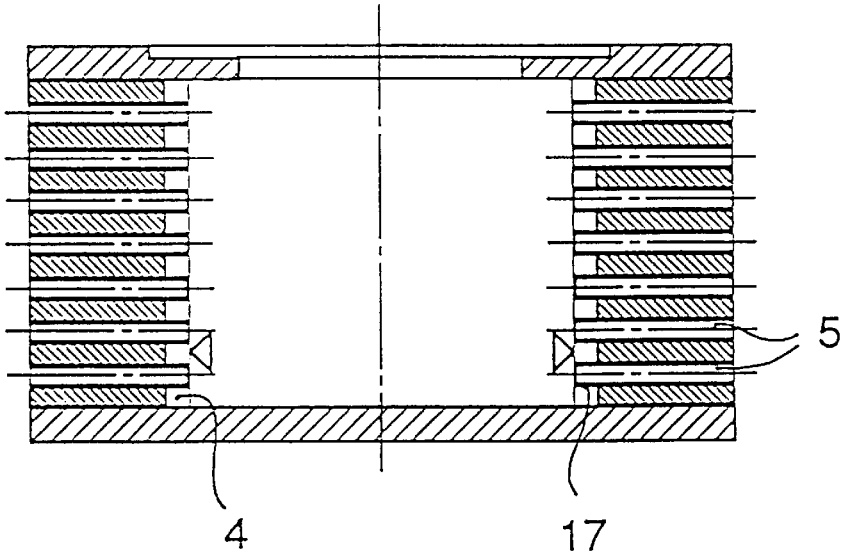
Figure 9:
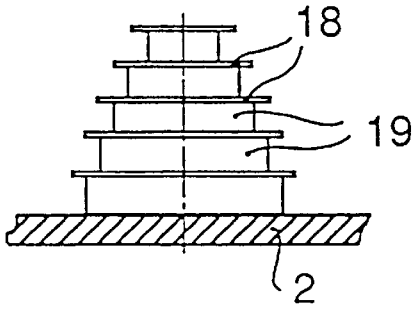
Figure 10:
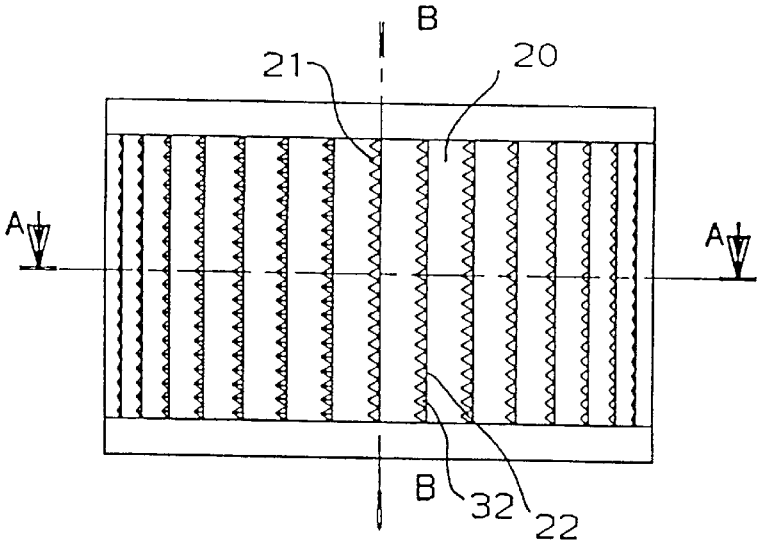
Figure 11:
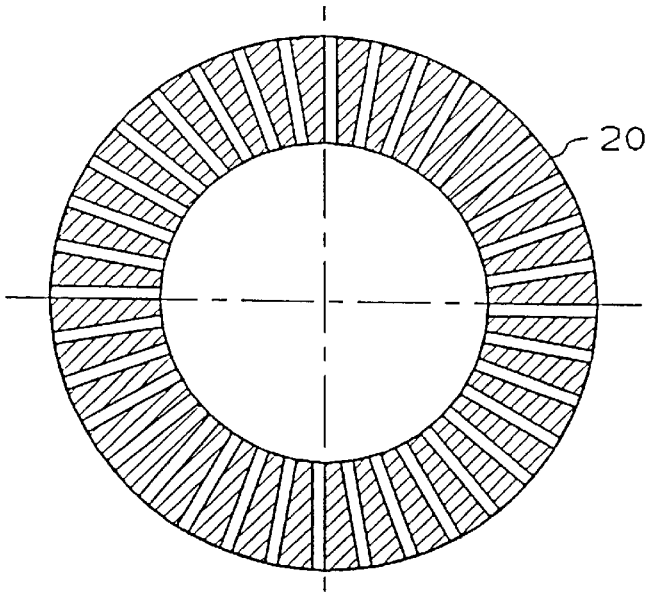
Figure 12:
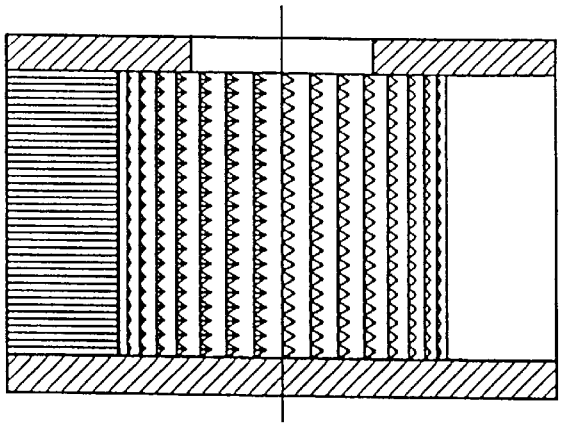
Figure 13:
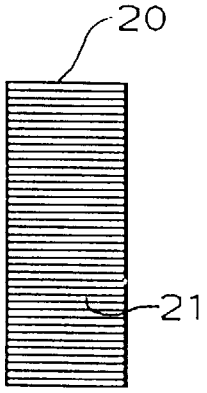
Figure 15:
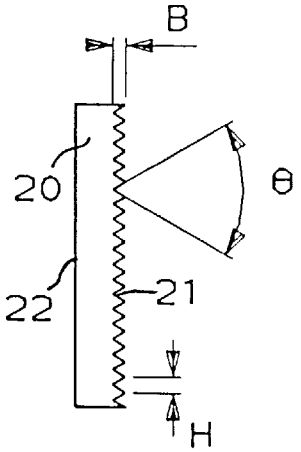
Figure 14:
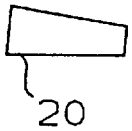
Figure 16:
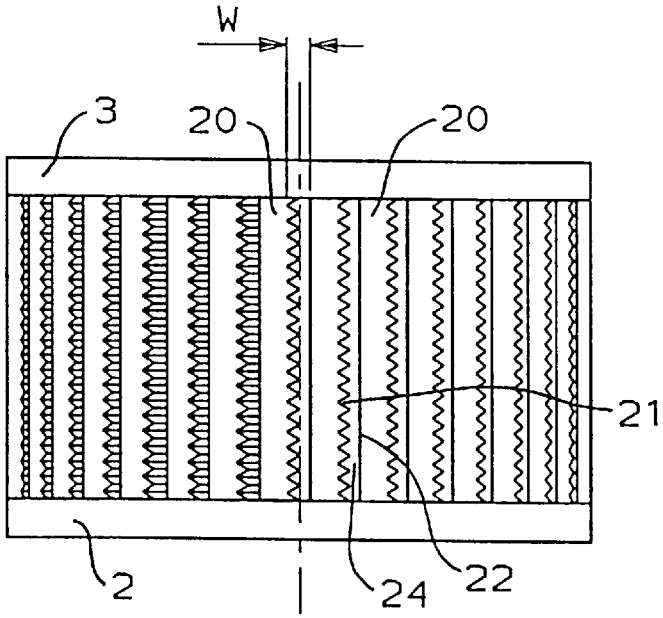
Figure 17:
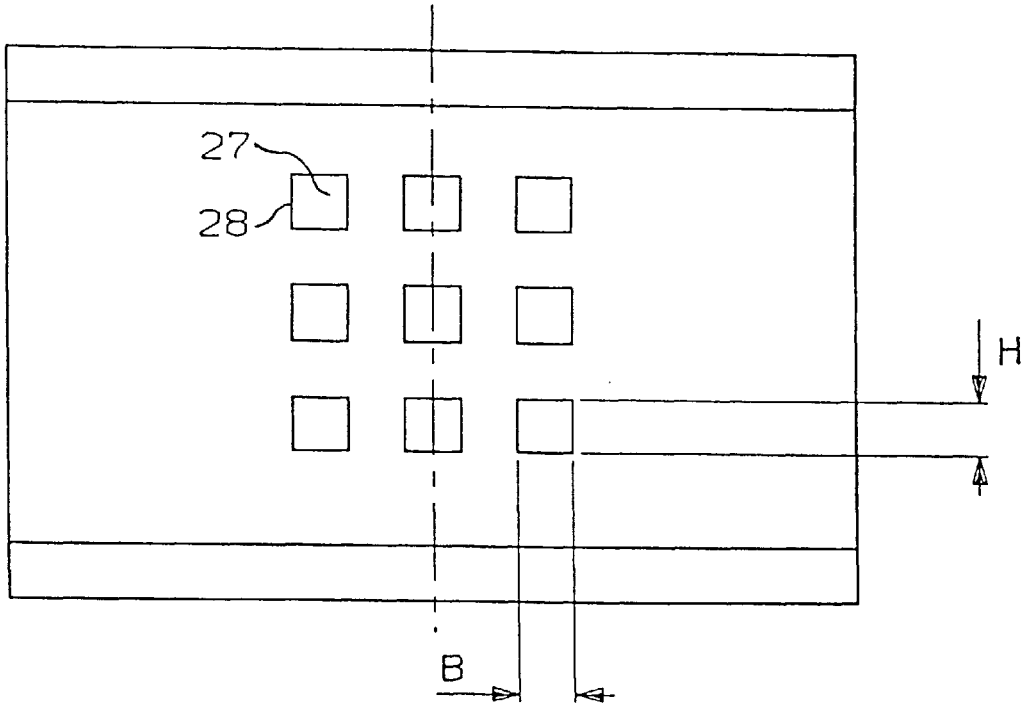
Figure 18:
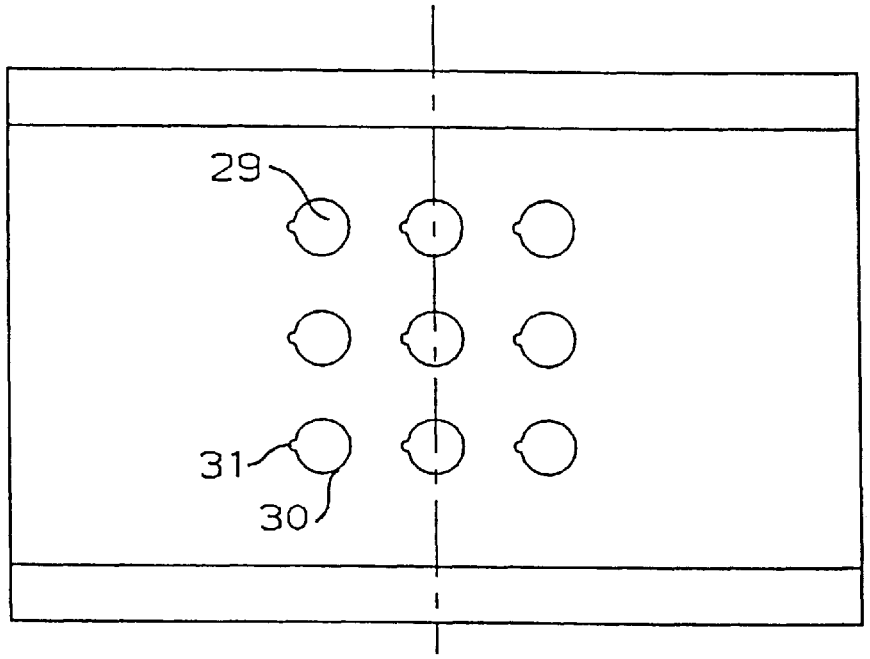

FIG. 3 illustrates a rotating cylinder with nozzles;

FIG. 4 is a cross-sectional view of a cylinder in the rotational plane;

FIG. 5 illustrates a cylinder in which the axes of the bores form an angle toward the rotational plane;

FIG. 6 is an axial cross-sectional view through a cylinder;

FIG. 7 is an axial cross-sectional view of a cylinder for use with a liquid free solids;

FIG. 8 illustrates a first preferred embodiment of the cylinder;

FIG. 9 illustrates a rotationally symmetrical distribution body;

FIG. 10 illustrates a lateral view of a cylinder having triangular apertures;

FIG. 11 is a cross-sectional view in the plane AA of the embodiment of FIG. 10;

FIG. 12 is an axial cross-sectional view along a plane of BB in FIG. 10;

FIGS. 13–15 illustrate portions forming the cylinder wall;

FIG. 16 is a side view of a cylinder having apertures with several V-shaped grooves;

FIG. 17 is a lateral view of an embodiment in which the bores of the cylinder wall are rectangular;

FIG. 18 shows another embodiment of the invention in which the apertures 29 are formed by cylindrical bores.

FIG. 1 shows a typical embodiment of the invention. The liquid 4 is injected into the rotating hollow cylinder consisting of the cylinder wall 1, the bottom 2 and the cover 3 with central aperture. The liquid leaves the cylinder through bores 5 in the cylinder wall 1 the rotation on the rotating hollow cylinder is indicated by the solid arrow 1*a*. The droplets are created at the outlet of the bores 5 by laminar jet disintegration. The cylinder wall is limited towards the interior by the interior cylinder surface 6 and towards the exterior by the exterior cylinder surface 7. The liquid 4 is evenly distributed on the inner cylinder surface 6 and consequently over the bores 5. In addition to the liquid also gas 8 flows into the cylinder. The gas leaves the cylinder together with the liquid 54 through the bores 5.

The even distribution of the liquid 4 on the interior cylinder surface 6 may for instance be performed by a single-fluid nozzle 9—the nozzle used here produces a cone-shaped spray jet—or by two-fluid nozzles 10. The distribution of the liquid 4 in the cylinder is improved by means of a distribution body 11. In the embodiment shown it consists of a body which is concentrical with the cylinder and the diameter of which increases towards the bottom 2. The distribution body 11 may be fixed with respect to the cylinder wall 1 or independently rotatable with respect thereto as indicated by the dashed arrow 11*a*. The distribution body 11 is provided at its upper surface with grooves 12 in the peripheral direction.

Baffles 13 in form of a cylindrical perforated plate are provided in the interior of the cylinder to distribute the liquid regularly on the interior cylinder surface 6 and on the bores 5. The baffles 13 may be fixed with respect to the rotating cylinder wall 1 or independently rotatable with respect thereto as indicated by a dot and dash arrow 13*a*. The cylinder wall 1 and, if applicable, the distribution body 11 and/or the baffles 13 is operated through the hollow shaft 13*b*.

FIG. 2*a* shows an axial sectional view through the hollow cylinder with bores 5 in the cylinder wall 1 and the reference numerals. The cylinder wall 1 is delimited by the interior cylinder surface 6 and the exterior cylinder surface 7. The cylinder is closed at the bottom by a bottom 2. On top the cover 3 with a central aperture is provided.

FIG. 2*b* shows a segment of the exterior cylinder surface 7 depicting the bores 5 and the references belonging thereto; here a triangular distribution is shown.

FIG. 2*c* is a cross-sectional view is a of the perforated cylinder in a rotational plane. On the drawing the cylinder wall 1, the exterior cylinder surface 7, the interior cylinder surface 6 and the bores 5 in the cylinder wall 1 can be seen.

FIG. 3 shows a rotating cylinder with bores 5 in the cylinder wall 1 and two rotating flat jet nozzles 9, which evenly distribute the liquid 4 on the interior cylinder surface 6, so that the throughput of liquid in each bore 5 is the same.

FIG. 4 is a cross-sectional view of a cylinder in a rotational plane, in which the extensions (14) of the axes of the bores 5 outside of the exterior cylinder surface 7 form an angle different from $\alpha$=90° to the direction of the vector of the peripheral speed. The direction of rotation according to arrow x, corresponding to $\alpha<90°$, is preferably used for low-viscous liquids or for reducing the $Re_\delta$—figure, the rotational direction according to arrow y or $\alpha>90°$, is preferably used for high-viscous liquids and suspensions.

FIG. 5, shows a cylinder, in which the axes 14 of the bores 5 in the cylinder wall 1 form an angle $\beta$ towards the rotational plane. Gas 8 flows in addition to the liquid 4 into the cylinder. The gas 8 leaving the cylinder through the bores 5 deflects the droplets of the liquid 4 in the axial direction of the cylinder. Also here the Re-figure is reduced in comparison with radially running bores.

FIG. 6 is an axial sectional view through a cylinder, which is particularly suited for suspensions. The bores 5 are provided with counterbores 15 in the interior of the cylinder. On account of the complex geometry of the surface only the intersection points of the bore axes 14 with the interior cylinder wall are indicated. Here a rectangular distribution is shown.

FIG. 7 is an axial sectional view of a cylinder, preferably for use with a liquid free of solids. In the cylinder a porous, cylindrical body 16 is present, said body being mounted concentrically to the cylinder and is restricting and equalizing the throughput of liquid at each bore 5.

FIG. 8 shows a preferred embodiment of the cylinder. In this embodiment, which is particularly suited for pure liquids and melts, the edges of the bores 5 protrude inwardly. Thereby a cylindrical liquid layer is produced, which leads to an identical overflow of the surplus liquid 4 to each bore 5. In this case small tubes 17 are inserted in the bores, said tubes all protruding with the same distance inwardly.

FIG. 9 shows a rotationally symmetrical distribution body 11, the diameter of which increases towards the bottom and which consists of circular plates 18 and the spacers 19.

FIG. 10 shows a lateral view of a cylinder with triangular apertures 32. The cylinder wall consists of portions 20 with V-shaped grooves 21. The triangular apertures 32 are delimited partly by the grooves 21 of the portion 20, partly by the backside 22 of the adjacent portion.

FIG. 11 shows a cross-sectional view in the plane A—A through the embodiment of the cylinder shown in FIG. 10.

FIG. 12 shows an axial sectional view in the plane B—B through the embodiment of the cylinder shown in FIG. 10.

FIG. 13 shows one of the portions 20, which forms part of the cylinder wall, seen towards the surface, which is provided W the V-shaped grooves 21.

FIG. 14 shows the same portion seen from above.

FIG. 15 shows the same portion 20, however, seen laterally. The angle indicated $\theta$ is the angle between the two surfaces of a groove. The width of an aperture, which is formed by a groove 21 and the adjacent plane backside of another portion 20 as shown in FIG. 10 is indicated by B and the heigh of this aperture by H.

FIG. 16 is a cylinder with larger apertures 24 having several V-shaped grooves 21. The cylinder wall consists of portions 20 with V-shaped grooves 21. The apertures 24 are delimited by the groove side of a portion 20, by the backside 22 of an adjacent portion 20, by the bottom of the cylinder 2 and by the cover of the cylinder 3. Several V-shaped grooves 21 are present in each aperture 24.

FIG. 17 is a lateral view of an embodiment, in which the bores in the cylinder wall are rectangular apertures 27. One wall 28 serves as flow surface.

FIG. 18 shows another embodiment according to which each of the apertures 29 are formed by 2 cylindrical bores, one of which, 30, has a substantially larger diameter than the other one, 31. During operation the last-mentioned, narrower bore serves as a U-shaped groove for the flow.

EXAMPLE 1

The device according to the invention is utilized for the manufacture of a spray dried powder from a suspension (4) with a density $\rho$=1000 kg/m$^3$, $\sigma$=60·10$^{-3}$ N/m and a viscosity of $\eta$=5·10$^{-3}$ Pas. The average droplet size is 250 $\mu$m. The suspension throughput (4) amounts to 1.0 t/h.

For this job a cylinder with an external diameter of 300 mm is chosen. The height of the bored cylinder portion H is 150 mm. At a quadrangular bore spacing of t=5 mm and a bore diameter of $D_B$=3 mm the number of bores is N=5600. The thickness of the cylinder wall (1) is chosen to s=15 mm. The thickness corresponds here to the bore length. The number n of revolutions per minute is 2000. The throughput of liquid per bore (5), characteristic of the invention, is $V_B$=4.9·10$^{-8}$ m$^3$/s, which corresponds to a specific bore throughput of $V_B/(\sigma^5/a^3\ \rho^5)^{0.25}$=6.85. The Reynolds figure calculated in accordance with the method described in the present specification amounts to Re$\delta$=10.3. The specific bore diameter is $D_B/(\sigma/\rho\ a)^{0.5}$=30. The ratio of the bore length $L_B$ the bore diameter $D_B$ is 6.7; the ratio of the bore spacing t the bore diameter $D_B$ is 1.67 which is in the range typical for the invention.

EXAMPLE 2

The same diameter D=300 mm and the same bored cylinder height $H_Z$=150 mm are chosen. The bores (5) are inclined downwards with $\beta$=45° towards the rotational plane. The bore spacing in the peripheral direction is $t_u$=4 mm, the bore spacing in the direction produced by the cylinder-generatrix amounts to $t_z$=4,5 mm, the bores (5) are triangularly arranged. Through this measure it becomes possible to provide a particularly big number, N=7850, of bores (5) on the cylinder surface (7) At the same throughput the number of bores is of considerable importance for the diameter of the droplets. Thus by this number of bores, the same amount of liquid (4) and same number of rotations as in Example 1 droplets with an average diameter of 215 $\mu$m are obtained. The ratio between bore length and bore diameter amounts to approx. 7. Gas (8) flows through the bores (5) at a speed of 40 m/s, in order to deflect the droplets formed downwards. The gas (8) has no effect on the formation of droplets. A further distribution of the droplets formed does not take place until by a Weber-number for the gas of $We_G=(v^2{}_G\rho_G\ d/\sigma)>12$. This corresponds in the present example to a speed of 49 m/s.

EXAMPLE 3

By atomizing 100 kg/h liquid lead (4) at a melt temperature of 400° C. a droplet size $d_{v,50}$=30 $\mu$m must be obtained. To avoid clogging the bores (5) are made with $D_B$=0.8 mm which is comparatively large compared with the required particle dimension. The bore spacing is t=0.5 mm, the number of bores in the cylinder amounts to N=2020 and the exterior diameter D of the cylinder is 80 mm. The thickness of the cylinder wall (1) is 5 mm. At a number of revolutions of 15,000 min$^{-1}$ an acceleration of a=92,000 m/s$^2$ is obtained, which results in the desired average droplet size of $d_{v,50}$=30 $\mu$m. For starting the cylinder is heated by hot gas (8), for instance argon, which flows through the bores (5) of the body. The liquid lead (1) is after the heating let out from a melt container and flows as a jet to a baffle plate or a distribution body (11) in the interior of the cylinder. Through the built in baffles (13), in this case several layers of wound wire netting, the melt (1) is evenly distributed on the interior cylinder surface (6) and consequently on the bores (5). The gas flow (8) is maintained during the operation in order to avoid a cooling of the cylinder and clogging of the bores (5).

What is claimed is:

1. A process for atomizing a liquid (4) comprising the steps of; introduction of said liquid into a hollow, rotatable cylinder having a cylinder wall (1) with an inner surface (6) and an outer surface (7) and having a plurality of bores (5) formed between said inner and outer surfaces, and rotating said cylinder at a predetermined rotational speed, wherein the liquid (4) being evenly distributed on said inner cylinder surface (6) and over said bores (5) provides per bore, a volumetric flow rate $V_B$ of the liquid (4) determined by $1.0<V_B(a^3\ \rho^5\sigma^5)^{0.25}<16$ and $V_B<3195\ (\eta^2/a\rho^2)^{7/6}(a\ \rho(D_B)^{0.5}/\eta)$, where a represents the centrifugal acceleration of the cylinder at said outer surface (7), $\rho$ is the density of the liquid (4), $\sigma$ is the surface tension of the liquid (4), and $\eta$ is the dynamic viscosity of the liquid (4), said centrifugal acceleration a being determined by a=2 D $\pi^2 n^2$, where D is the diameter of said outer surface (7), $D_B$ is the diameter of each bore (5), and n is said predetermined rotational speed, whereby a laminar disintegration of jets of said liquid leaving said plurality of bores is produced.

2. A device of atomizing a liquid (4) comprising; a hollow rotatable cylinder having a cylinder wall (10 with an inner surface (6), an outer surface (7), a bottom side closed by a bottom (2) and an upper side limited by a cover (3) with a central opening, a plurality of bores (5) each with a diameter $D_B$ being formed in the cylinder wall (1) between said inner and outer surfaces (6, 7), wherein the arrangement of said bores with a spacing t measured on said outer surface (7) determined by 1.1 $D_B$<t<5 $D_B$, the ratio of the length $L_B$ of each bore (5) between said inner and outer surfaces (6, 7) to said bore diameter $D_B$ being at least 3 and said bore diameter $D_B$ being determined by $10<D_B\ (\rho\ a/\sigma)^{0.5}<50$ for the production of droplets with an average sizes smaller than 100 $\mu$m, where a represents the centrifugal acceleration of the cylinder at said outer surface $\rho$ is the density of the liquid (4) and $\sigma$ is the surface tension of the liquid (4), said centrifugal acceleration a being determined by a=2 D $\pi^2$ n$^2$, where D is the diameter of said outer surface (7); whereby a laminar disintegration of jets of said liquid leaving said plurality of bores is produced.

3. A device of atomizing a liquid (4) comprising; a hollow rotatable cylinder having a cylinder wall (1) with an inner surface (6), an outer surface (7), a bottom side closed by a bottom (2) and an upper side limited by a cover (3) with a central opening, a plurality of bores (5) each with a diameter $D_B$ being formed in the cylinder wall (1) between said inner and outer surfaces (6, 7), wherein the arrangement of said bores with a spacing t measured on said outer surface (7) determined by 1.1$D_B$<t<5 $D_B$, the ratio of the length $L_B$ of each bore (5) between said inner and outer surfaces (6, 7) to said bore diameter $D_B$ being at least 3 and said bore diameter $D_B$ being determined by $10<D_B\ (\rho\ a/\sigma)^{0.5}<200$ for the production of droplets with an average sizes smaller than 100 $\mu$m, where a represents the centrifugal acceleration of the cylinder at said outer surface $\rho$ is the density of the liquid (4) and σ is the surface tension of the liquid (4), said centrifugal acceleration a being determined by a=2 D or $\pi^2 n^2$ $n^2$ where D is the diameter of said outer surface (7); whereby a laminar disintegration of jets of said liquid leaving said plurality of bores is produced.

4. A process for atomizing a liquid (4) comprising the steps of; introduction of said liquid into a hollow, rotatable cylinder having a cylinder wall (1) with an inner surface (6) and an outer surface (7) and having a plurality of bores (5) formed between said inner and outer surfaces, and rotating said cylinder at a predetermined rotational speed, wherein the liquid (4) being evenly distributed on said inner cylinder surface (6) and over said bores (5) provides per bore, a volumetric flow rate $V_B$ of the liquid (4) determined by $1.0<V_B\ (a^3\ \rho^5/\sigma^5)^{0.25}<16$ and $V_B<3195\ (\eta^2/a\rho^2)^{7/6}(a\ \rho\ (D_B)^{0.5}/\eta)$, where a represents the centifugal acceleration of the cylinder at said outer surface (7), ρ is the density of the liquid (4), σ is the surface tension of the liquid (4), and η is the dynamic viscosity of the liquid (4), said centrifugal acceleration a being determined by a=2 D $\pi^2 n^2$, where D is the diameter of said outer surface (7), $D_B$ is the diameter of each bore (5), and n is said predetermined rotational speed, whereby a laminar disintegration of jets of said liquid leaving said plurality of bores is produced.

5. A process according to claim 4, characterized in that in addition to liquid (4) gas (8) is also introduced.

6. A process according to claim 4, characterized in that the liquid (4) is injected into the cylinder by means of a one-fluid nozzle (9).

7. A process according to claims 4, characterized in that the liquid (4) is injected into the cylinder through one or more rotating nozzles (9) or (10).

8. A process according to claim 4, characterized in that the nozzle produces a hollow conical spray jet.

9. A process according to claim 4, characterized in that $$\dot{V}_B<1410\ (\eta^2/a\ \rho^2)^{7/6}\ (a\ \rho\ \sqrt{D_B}/\eta).$$

10. A device according to claim 4, characterized by baffles (13) which are built into the cylinder.

11. Use of the device according to claim 4 for spray drying products.

12. Use of the device according to claim 4 for the manufacture of powders from melts.

13. Use of a device according to claim 4 for gas purification in scrubbing plants.

14. A device according to claim 4, characterized by at least 200 bores (5), apertures (27), (29), (32) or grooves (21).

15. A device for atomizing a liquid (4) comprising; a hollow rotatable cylinder having a cylinder wall (1) with an inner surface (6), an outer surface (7), a bottom side closed by a bottom (2) and an upper side limited by a cover (3) with a central opening, a plurality of bores (5) each having a diameter $D_B$ being formed in the cylinder wall (1) between said inner and outer surfaces (6, 7), wherein the arrangement of said bores with a spacing t measured on said outer surface (7) is determined by $1.1\ D_B<t<5\ D_B$, the ratio of the length $L_B$ of each bore (5) between said inner and outer surfaces (6, 7) to said bore diameter $D_B$ being at least 3 and said bore diameter $D_B$ being determined by $10<D_B\ (\rho\ a/\sigma)^{0.5}<50$ for the production of droplets with an average size equal to or greater than 100 μm, where a represents the centrifugal acceleration of the cylinder at said outer surface, ρ is the density of the liquid (4) and σ is the surface tension of the liquid (4), said centrifugal acceleration a being determined by a=2 D $n^2$-$n^2$, where D is the diameter of said outer surface (7), and at least 200 bores (5), apertures (27), (29), (32) or grooves (21).

16. A device according to claim 15, characterized by a rotationally symmetrical and in the cylinder concentrically arranged distribution body (11), the diameter of which increases towards the bottom (2).

17. A device according to claim 16, characterized by baffles (13) in form of concentrically arranged cylindrical perforated plates, the aperture diameter of which is bigger than the bores (5).

18. A device according to claim 15, characterized by a distribution body (11), which is fixed to the cylinder.

19. A device according to claim 15, characterized by a distribution body (11) which is independently rotatable with respect to the cylinder.

20. A device according to claim 15, characterized by a distribution body (11), which is provided with grooves (12) running in the peripheral direction.

21. A device according to claim 20, characterized by baffles (13) which are independently rotatable with respect to the cylinder.

22. A device according to claim 15, characterized in bores (5) or apertures (24) (27), (29), (32) having such directions that the extensions of their axes (14) over the exterior cylinder surface (7) all keep the same angle α in the range of $10°<\alpha<170°$ in relation to the vector of the peripheral speed.

23. A device according to claim 15, characterized in bores (5) having such directions that the extensions of the bore axes (14) thereof over the exterior cylinder surface being inclined (7) by the angle β in the range of $O<\beta<80°$ in relation to the plane of rotation.

24. A device according to claim 15, wherein a laminar flow is produced for which the Reynold's figure $Re_\delta$ does not exceed 400.

25. A device for atomizing a liquid (4) comprising; a hollow rotatable cylinder having a cylinder wall (1) with an inner surface (6), an outer surface (7), a bottom side closed by a bottom (2) and an upper side limited by a cover (3) with a central opening, a plurality of bores (5) each with a diameter $D_B$ being formed in the cylinder wall (1) between said inner and outer surfaces (6, 7), wherein the arrangement of said bores with a spacing t measured on said outer surface (7) determined by $1.1\ D_B<t<5\ D_B$, the ratio of the length $L_B$ of each bore (5) between said inner and outer surfaces (6, 7) to said bore diameter $D_B$ being at least 3 and said bore diameter $D_B$ being determined by $10<D_B\ (\rho\ a/\sigma)^{0.5}<200$ for the production of droplets with an average size smaller than 100 μm, where a represents the centrifugal acceleration of the cylinder at said outer surface ρ is the density of the liquid (4) and σ is the surface tension of the liquid (4), said centrifugal acceleration a being determined by a=2 D $n^2$-$n^2$, where D is the diameter of said outer surface (7), and at least 200 bores (5), apertures (27), (29), (32) or grooves (21).

26. A device according to claim 25, characterized by at least 200 bores (5), apertures (27), (29), (32) or grooves (21).

27. A device according to claim 25, characterized in bores (5) or apertures (24) (27), (29), (32) having such directions that the extensions of their axes (14) over the exterior cylinder surface (7) all keep the same angle α in the range of $10°<\alpha<170°$ in relation to the vector of the peripheral speed.

28. A device according to claim 25, characterized in bores (5) having such directions that the extensions of the bore axes (14) thereof over the exterior cylinder surface being inclined (7) by the angle β in the range of $O<\beta<80°$ in relation to the plane of rotation.

29. A device according to claim 25, wherein a laminar flow is produced for which the Reynold's Figure $Re_\delta$ does not exceed 400.

* * * * *

UNITED STATES PATENT AND TRADEMARK OFFICE

CERTIFICATE OF CORRECTION

PATENT NO. : 6,098,895 
DATED : August 8, 2000
INVENTOR(S) : Peter Walzel, Christian Reedtz Funder, Soren B. Flyger and Poul Bach It is certified that error appears in the above-identified patent and that said Letters Patent is hereby corrected as shown below:

Column 1,
Line 6, change "Pat/DK94/00113" to -- PCT/DK94/00113 --.

Column 3,
Line 56, please delete "VB" and insert -- $V_B$ --.

Column 4,
Line 5, please delete "√D is. D" and insert -- D is --.

Column 5,
Line 18, please delete "σ/" and insert -- σ --.
Line 18, please delete "ρ/" and insert -- ρ --.

Column 7,
Line 11, please delete "O" and insert -- 0º --.

Column 8,
Lines 28 and 32, please delete "ρm" and insert -- $\mu$m --.

Column 12,
Line 36, please delete "(10" and insert -- (1) --.
Line 46, please delete "sizes smaller" and insert -- size equal to or greater. --
Line 48, after "surface" please add -- , --.
Line 65, please delete "sizes" and insert -- size --.

Column 13,
Line 2, please delete "a = 2D or $\pi^2n^2$" and insert -- a = $2D\pi^2n^2$ --.
Line 3, please delete "$n^2$".
Lines 22-23, please delete "whereby a laminar disintegration of jets of said liquid leaving said plurality of bores is produced" and insert -- such that in each of said plurality of bores a laminar flow is produced for which the Reynolds figure $Re_\delta$ does not exceed 400 --.
Line 64, please delete "$n^2$-$n^2$" and insert -- $\pi^2n^2$ --.

UNITED STATES PATENT AND TRADEMARK OFFICE

CERTIFICATE OF CORRECTION

PATENT NO. : 6,098,895 
DATED : August 8, 2000
INVENTOR(S) : Peter Walzel, Christian Reedtz Funder, Soren B. Flyger and Poul Bach It is certified that error appears in the above-identified patent and that said Letters Patent is hereby corrected as shown below:

Column 14,
Line 27, please delete "O" and insert -- 0º --.
Line 47, please delete "$n^2$-$n^2$" and insert -- $\pi^2 n^2$ --.
Line 61, please delete "O" and insert -- 0º --.

Signed and Sealed this

Seventh Day of January, 2003

JAMES E. ROGAN
*Director of the United States Patent and Trademark Office*